United States Patent [19]

Hall

[11] Patent Number: 4,940,135

[45] Date of Patent: Jul. 10, 1990

[54] CARTRIDGE HOLDER

[76] Inventor: Dennis C. Hall, Rte. 1, Box 625, Duncanville, Ala. 35456

[21] Appl. No.: 417,307

[22] Filed: Oct. 5, 1989

[51] Int. Cl.[5] ..... B25C 1/00

[52] U.S. Cl. ..... 206/3; 206/459; 220/307

[58] Field of Search ..... 206/3, 459; 220/307

[56] References Cited

U.S. PATENT DOCUMENTS

| | | | |
|---|---|---|---|
| 123,884 | 2/1872 | Frazier . | |
| 1,218,814 | 3/1917 | Steinmetz | 206/3 |
| 3,101,840 | 8/1963 | Canning, Jr. et al. . | |
| 3,373,520 | 3/1968 | Into | 206/3 |
| 3,520,400 | 7/1970 | Gates | 206/3 |
| 3,811,977 | 5/1974 | Kramer | 206/459 |
| 3,915,355 | 10/1975 | Young | 206/459 |
| 3,990,170 | 11/1976 | Griffis . | |
| 4,199,093 | 4/1980 | Combette et al. | 206/3 |
| 4,288,197 | 9/1981 | Gurolnick . | |
| 4,412,613 | 11/1983 | Kubas | 206/459 |
| 4,757,894 | 7/1988 | Schreckenstein . | |

*Primary Examiner*—Joseph Man-Fu Moy

*Attorney, Agent, or Firm*—Jerry T. Kearns

[57] ABSTRACT

A cartridge holder for carrying firearm cartridges includes an elongated cylindrical tube having opposite open ends. A removable cap is received in each of the open ends. A plurality of firearm cartridges are stacked in front end to rear end coaxial relation within the tube. Indicia on an outer surface of the tube designates a forwardly facing direction of the cartridges. One of the removable caps may be selectively removed to load a forwardly or a rearwardly opening magazine of a firearm. An enlarged diameter hollow quiver is disclosed for carrying a plurality of the tubes in parallel adjacent relation. A belt engaging hook on the quiver allows a large quantity of firearm ammunition to be conveniently transported for rapid loading.

4 Claims, 3 Drawing Sheets

CARTRIDGE HOLDER

BACKGROUND OF THE INVENTION

1. Field of the Invention

The present invention relates to cartridge holders, and more particularly pertains to a cartridge holder for use with .22 caliber firearm rim fire cartridges. Several different models of .22 caliber rim fire rifles and carbines utilize tubular magazines to store a quantity of firearm cartridges in front end to rear end coaxial relation. Some of these conventional firearms have a forwardly opening magazine and require that the cartridges be inserted rear end first. Other conventional types of firearms utilizing tubular magazines have a rearwardly opening magazine, requiring that the cartridges be inserted forward end first. Conventionally, an individual is required to insert cartridges in these conventional firearms in a one at a time manner, while paying particular attention to the correct orientation of each cartridge. This is a time consuming task, and requires tedious individual manipulation of a large number of individual cartridges. In order to overcome these problems, the present invention provides a cartridge holder for storing and loading a large quantity of cartridges into firearms having either forwardly or rearwardly opening tubular magazines.

2. Description of the Prior Art

Various types of cartridge holders are known in the prior art. A typical example of such a cartridge holder is to be found in U.S. Pat. No. 123,884, which issued to J. Frazier on Feb. 20, 1872. This patent discloses a cartridge box having a pair of parallel rows of cylindrical bores formed in a cartridge holding block. The device includes a pair of hingedly connected cartridge blocks so they can be readily folded to a compact orientation. U.S. Pat. No. 3,101,840, which issued to G. Canning Jr. et al on Aug. 27, 1963, discloses a package for firearm cartridges which includes a plurality of cYlindrical bores oriented in a rectangular matrix in a block. U.S. Pat. No. 3,990,170, which issued to W. Griffis on Nov. 9, 1976, discloses a portable cartridge holder that includes first and second rectangular cups having handles projecting from first ends thereof, with the cups being pivotally connected on their second ends, and when in a first position, the cups have free rectangular edges thereof in abutting contact. U.S. Pat. No. 4,288,197, which issued to R. Gurolnick on Sept. 8, 1981, discloses a firearm cartridge package which is formed from a single board or transparent blank. The cartridge package permits an individual to conveniently carry and load a plurality of cartridges. U.S. Pat. No. 4,757,894, which issued to W. Schreckenstein on July 19, 1988, discloses a shotgun shell case including a box-like receptacle having a plurality of individual shell receiving pockets and a hinged cover. A belt engagement loop is provided for attaching the case on the belt of a user.

While the above mentioned devices are directed to cartridge holders, none of these devices disclose a cartridge holder formed as an elongated hollow cylindrical tube dimensioned to receive a plurality of firearm cartridges in front end to rear end coaxial stacked relation and including removable caps at opposite open ends to allow rapid loading of firearms having either a forwardly opening tubular magazine or a rearwardly opening tubular magazine. Additional features of the present invention, not contemplated by the aforesaid prior art devices, include the use of an enlarged diameter hollow cylindrical quiver for storing a plurality of reduced diameter elongated tubular cartridge holders in parallel adjacent relation. Inasmuch as the art is relatively crowded with respect to these various types of cartridge holders, it can be appreciated that there is a continuing need for and interest in improvements to such cartridge holders, and in this respect, the present invention addresses this need and interest.

SUMMARY OF THE INVENTION

In view of the foregoing disadvantages inherent in the known types of cartridge holders now present in the prior art, the present invention provides an improved cartridge holder. As such, the general purpose of the present invention, which will be described subsequently in greater detail, is to provide a new and improved cartridge holder which has all the advantages of the prior art cartridge holders and none of the disadvantages.

To attain this, a representative embodiment of the concepts of the present invention is illustrated in the drawings and makes use of a cartridge holder for carrying firearm cartridges which includes an elongated cylindrical tube having opposite open ends. A removable cap is received in each of the open ends. A plurality of firearm cartridges are stacked in front end to rear end coaxial relation within the tube. Indicia on an outer surface of the tube designates a forwardly facing direction of the cartridges. One of the removable caps may be selectively removed to load a forwardly or a rearwardly opening magazine of a firearm. An enlarged diameter hollow quiver is disclosed for carrying a plurality of the tubes in parallel adjacent relation. A belt engaging hook on the quiver allows a large quantity of firearm ammunition to be conveniently transported for rapid loading.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cartridge holder which has all the advantages of the prior art cartridge holders and none of the disadvantages.

It is another object of the present invention to provide a new and improved cartridge holder which may be easily and efficiently manufactured and marketed.

It is a further object of the present invention to provide a new and improved cartridge holder which is of a durable and reliable construction.

An even further object of the present invention is to provide a new and improved cartridge holder which is susceptible of a low cost of manufacture with regard to both materials and labor, and which accordingly is then susceptible of low prices of sale to the consuming public, thereby making such cartridge holders economically available to the buying public.

Still yet another object of the present invention is to provide a new and improved cartridge holder which provides in the apparatuses and methods of the prior art some of the advantages thereof, while simultaneously overcoming some of the disadvantages normally associated therewith.

Still another object of the present invention is to provide a new and improved cartridge holder for conveniently packaging and transporting a plurality of firearm cartridges.

Yet another object of the present invention is to provide a new and improved cartridge holder which allows firearms having either a forwardly opening or a rearwardly opening tubular magazine to be rapidly loaded.

Even still another object of the present invention is to provide a new and improved cartridge holder which allows a large number of rapidly loaded cartridge packages to be conveniently transported on a belt engaging quiver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
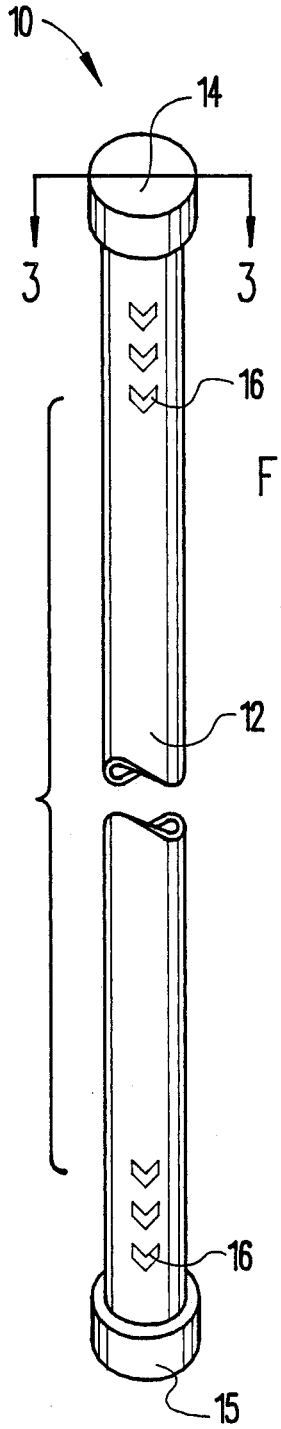
FIG. 1 is a perspective view of the cartridge holder according to the present invention.

With reference now to the drawings, and in particular to FIG. 1 thereof, a new and improved cartridge holder embodying the principles and concepts of the present invention and generally designated by the reference numeral 10 will be described.

More specifically, it will be noted that the first embodiment 10 of the invention includes an elongated cylindrical tube 12. The tube 12 is preferably formed with a length of about 14 inches and a 9/32 inch diameter to hold a quantity of conventional .22 caliber rim fire cartridges. Alternatively, the tube 12 may be formed in a shorter length for use with conventional .22 caliber short cartridges. A pair of removable caps 14 and 15 are received in opposite open ends of the tube 12. Indicia 16 is provided at adjacent each end of the tube 12 and indicates a forwardly facing direction of .22 caliber firearm cartridges stored in forward end to rearward end stacked coaxial relation within the tube 12. The end caps 14 and 15 are identically constructed, and allow the stored cartridges to be dispensed from either end of the tube 12. The tube 12 may be formed from a PVC type plastic material or may be inexpensively formed from a laminated, spirally wound metallized cardboard or foil material. The construction of the tube 12 should be such to provide a rigid and waterproof package. It is contemplated that a predetermined standard quantity of .22 caliber rim fire cartridges may be originally sold in the holder 10.

Figure 2:
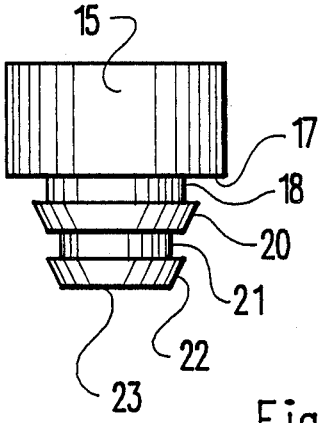
FIG. 2 is a side elevational view of a removable cap for the cartridge holder of FIG. 1.

FIG. 2 is a side elevational view, illustrating the construction of the end cap 15, identically formed as the end cap 14. A radially extending flange 17 is formed by an intersection of the exterior cylindrical portion of the cap 15 with a reduced diameter cylindrical stem 18. A pair of stepped diameter frusto conical portions 20 and 22 are spaced along the length of the stem 18, and are joined by a reduced diameter end stem portion 21. The insertion stem terminates in a transverse circular end face 23 which forms an abutment surface for an end face of a firearm cartridge.

Figure 3:
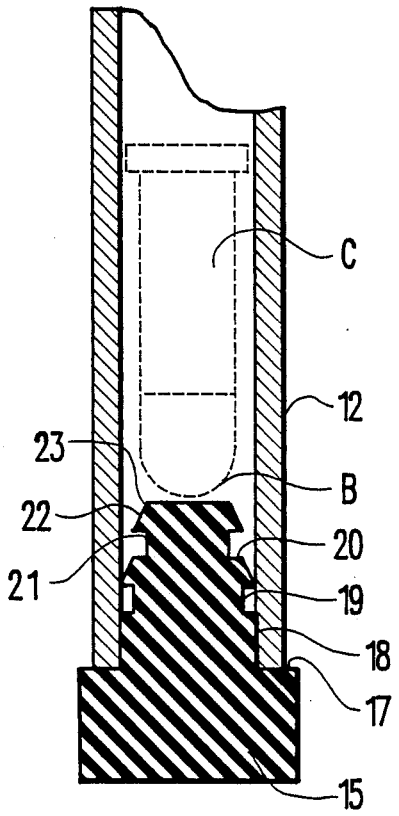
FIG. 3 is a cross sectional detail view, further illustrating the construction of the cartridge holder of FIG. 1.

FIG. 3 illustrates a cross sectional view which shows the cap 15 inserted within an open end of the tube 12. The radially extending flange portion 17 has a diameter slightly greater than the tube 12 and allows the cap 15 to be easily removed by a user. The stem 18 is dimensioned for water tight frictional engagement within the open end of the tube 12. The axially spaced frusto conical steps 20 and 22 facilitate installation of the stem 18 within the tube 12. The abutment face 23 of the stem 18 provides a cushion surface to prevent damage to the bullet B of the cartridge C. The caps 14 and 15 are preferably formed from a resilient rubber material.

Figure 4:
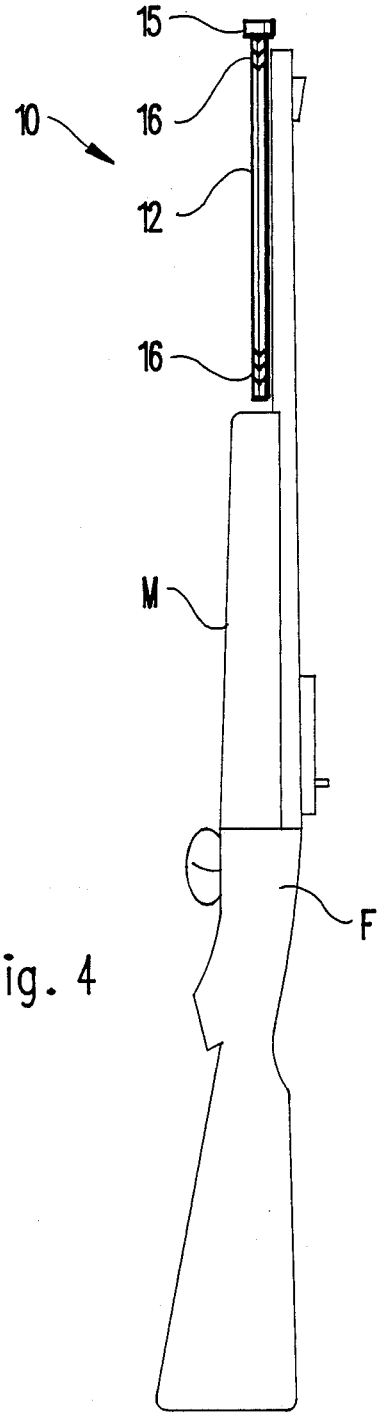
FIG. 4 is a side elevational view illustrating the manner of use of the cartridge holder of the present invention to load a firearm having a forwardly opening tubular magazine.

As shown in FIG. 4, the holder 10 may be oriented as shown, with the end cap 14 removed, to load cartridges into a firearm F of the type having a magazine M with a forwardly directed opening. The indicia 16 allows a full proof orientation of the tube 12 in a proper direction, because the indicia 16 takes the form of arrows which a user merely points in the same direction as the barrel of the firearm F. The end cap 14 has been removed, allowing the entire contents of the tube 12 to be rapidly loaded into the magazine M. As may now be understood, this allows the firearm F to be conveniently and rapidly loaded, with cartridges that have not been individually handled by an individual. This prevents the introduction of dirt and other contaminants into the internal working mechanisms of the firearm F.

Figure 5:
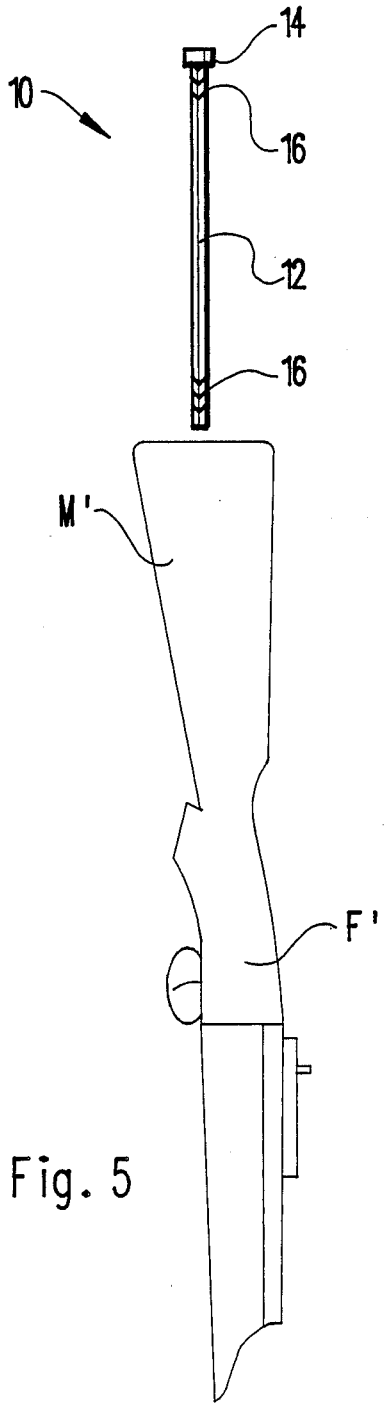
FIG. 5 is side elevational view illustrating the manner of use of the cartridge holder of the present invention to load a firearm having a rearwardly opening tubular magazine.

FIG. 5 illustrates the use of the cartridge holder 10, with another conventional form of firearm F′ of the type having a rearwardly opening magazine M′ formed in the butt stack portion of the gun. To load this type of firearm F′, the end cap 15 is removed from the tube 12, and the tube 12 is again oriented with the arrow indicia 16 pointing in the direction of the barrel of the firearm F′. As may now be understood, the present invention provides a single form of cartridge holder which is adaptable for use in a variety of different firearms.

Figure 6:
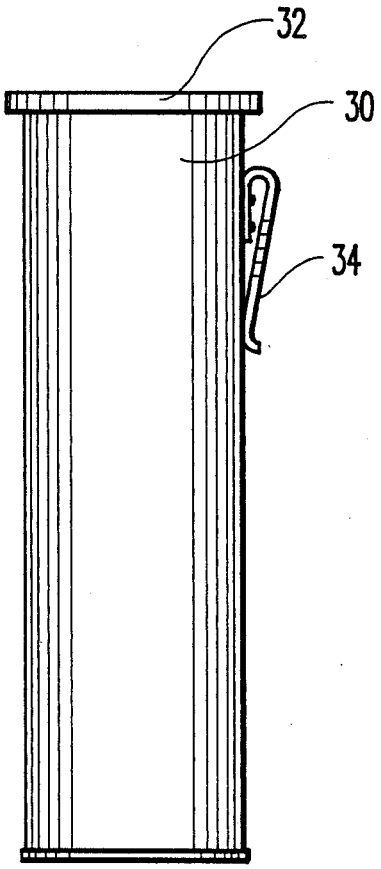
FIG. 6 is a side elevational view illustrating a storage and transportation quiver for carrying a plurality of the cartridge holder of FIG. 1.

FIG. 6 illustrate a hollow cylindrical quiver 30 which has an oversized diameter dimensioned to receive a plurality of the individual cartridge holders 10 illustrated in FIG. 1. The quiver 30 has an upper peripheral rim 32, surrounding an open top end. A removable snap type plastic cover may be installed over the open top end, in engagement with the peripheral rim 32. A frictional belt engaging hook 34 is provided on an external surface of the quiver 30, to enable the entire quiver 30 to be conveniently transported by an individual while hunting, hiking, or camping.

Figure 7:
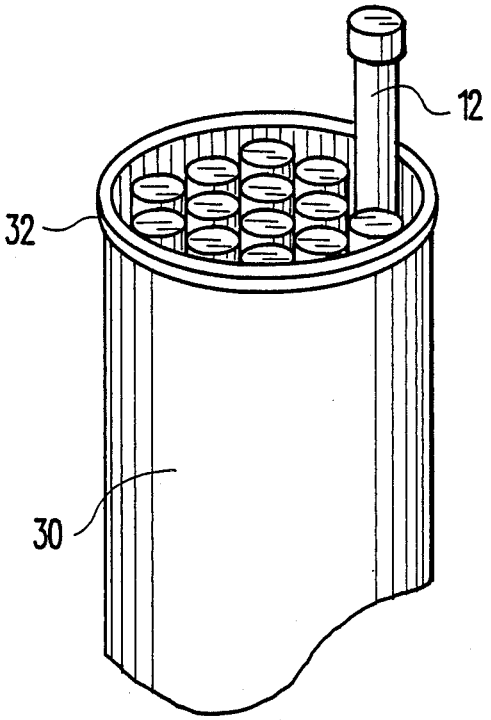
FIG. 7 is a partial perspective view further illustrating the quiver of FIG. 5.

As shown in FIG. 7, the quiver 30 is dimensioned to receive a plurality of the holder tubes 12, in adjacent parallel relation. It is contemplated that the quiver 30 may be sold as a single package, to include a plurality of the individual tubes 12. The quiver 30 may be formed in the manner of the tubular package utilized to market a conventional form of potato chips sold under the trademark "PRINGLES". The quiver 30 may be formed from a plastic construction having a snap on type resilient plastic cap, or may be alternatively formed from a metallized laminated helically wound cardboard material. As may now be understood, the present invention provides a novel cartridge holder and package which allows a large number of firearm cartridges to be stored in and transported in a compact size. Additionally, the cartridge holder of the present invention allows cartridges to be extremely rapidly loaded into firearms having either a forwardly or a rearwardly opening tubular magazine, without requiring any manual manipulation of individual cartridges.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cartridge holder for carrying firearm cartridges, comprising:

an elongated cylindrical tube having opposite open ends;

a plurality of firearm cartridges stacked in front end to rear end coaxial relation within said tube;

a removable cap at each of said opposite open ends of said tube;

each of said removable caps including a generally cylindrical rubber body having a reduced diameter stem dimensioned for insertion into and frictional engagement with an open end of said tube, said reduced diameter stem of each of said caps providing a shock absorbing end face for abutment with an end of a firearm cartridge;

an exterior radial flange on each of said caps having a diameter greater than an external diameter of said tube;

a plurality of frusto conical flanges stepped along said stem of each of said caps; and indicia on an external surface of said tube indicating a forward facing direction of said firearm cartridges, whereby a selected one of said removable caps may be removed to load a forwardly or rearwardly opening firearm magazine.

2. The cartridge holder of claim 1, wherein said tube is formed from a plastic material.

3. The cartridge holder of claim 1, further comprising an enlarged diameter hollow cylindrical quiver receiving a plurality of said tubes in parallel adjacent relation.

4. The cartridge holder of claim 3, further comprising a belt engaging clip on said quiver.

* * * * *